US007817931B2

(12) United States Patent
Takeuchi

(10) Patent No.: US 7,817,931 B2
(45) Date of Patent: Oct. 19, 2010

(54) IMAGE-FORMING SYSTEM WITH MULTIPLE POST-PROCESSING

(75) Inventor: Naoki Takeuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 392 days.

(21) Appl. No.: 11/973,969

(22) Filed: Oct. 11, 2007

(65) Prior Publication Data

US 2008/0124104 A1 May 29, 2008

(30) Foreign Application Priority Data

Oct. 16, 2006 (JP) ..... 2006-282026

(51) Int. Cl.
*G03G 15/00* (2006.01)

(52) U.S. Cl. ..... 399/45; 399/407

(58) Field of Classification Search ..... 399/45, 399/82, 85, 407

See application file for complete search history.

(56) References Cited

U.S. PATENT DOCUMENTS

2006/0127122 A1* 6/2006 Arai ..... 399/82

FOREIGN PATENT DOCUMENTS

JP 11-171398 6/1999

* cited by examiner

*Primary Examiner*—David M Gray
*Assistant Examiner*—Erika Villaluna
(74) *Attorney, Agent, or Firm*—Dilworth & Barrese LLP.

(57) ABSTRACT

An image-forming system determines a type of paper for each single sheet in a job to determine whether it is prohibited to discharge a sheet to a finisher (step S12) to respond to diversifying demands to perform processes after printing using a plurality of paper types. However, the system allows paper to be included in a sheet bundle if the number of sheets is below a fixed limited number of sheets, even if paper types used are inappropriate for the finisher to be the discharge destination. (Steps S14, and Spaces 16) Therefore, discharge to the finisher is not rejected uniformly by the type of paper; finishing can be implemented after printing with a certain degree flexibility.

4 Claims, 4 Drawing Sheets

IMAGE-FORMING SYSTEM WITH MULTIPLE POST-PROCESSING

This application is based on and claims the benefit of priority from Japanese Patent Application No. 2006-282026, filed on 16 Oct. 2006, the content of which is incorporated herein by reference.

BACKGROUND OF THE INVENTION

1. Field of the Invention

The present invention relates to image-forming systems that form images using printers, copiers, facsimile machines or multi-function peripherals that combine these devices, and discharge image-transferred sheets after undergoing a predetermined finishing process.

2. Related Art

Particularly, an output-sheet stacking and finishing apparatus equipped with functions that stacks and outputs sheets output from an image-forming apparatus is known in the related art of these kinds of image-forming systems. A specific point of interest was that the thickness of output sheets varies according to the properties of the paper having a dramatic affect on the stacking load in stacking and finishing apparatuses. In other words, because there is greater mass (basic weight) per unit area in paper whose thickness is greater, the stacking load is that much greater even when the same number of sheets is stacked. The result is the discharge bin cannot withstand the stacking load which invites damage or improper operations.

In view of that problem, stacking apparatuses of the related art were particularly set with a maximum stacking amount of output paper that is within a range where operations can be guaranteed. This set maximum stacking amount is reflected in the default number of sheets that can be stacked in view of the output paper properties. For example, output paper with a high mass per unit area has a lower limit of the number of sheets that can be stacked. Conversely, output paper with a low mass per unit area has a higher limit of the number of sheets that can be stacked. In either case, the stacking apparatus can stack output paper within a range of the maximum stacking amount, so there is no need for concern about damaging the discharge bin or inviting improper operations.

As was provided as an example with the related art, image-forming systems handle a plurality of paper types. Thus, these systems have different discharge destinations and methods for finishing sheets after printing because of the differences in paper types (particularly, the thicknesses of paper). For example, if a system is equipped with a finisher that bundles and staples printed sheets, the printed sheets are bundled once at a stacker and a process to staple the bundle is applied thereupon. The number of sheets that can be bundled at the stacker is limited, but if the number of sheets is within the upper limit of the number of sheets, normally, the stapling process by a stapler can be performed without any problems.

However, the upper limit of the number of sheets that the stacker can hold is set assuming sheets with an ordinary thickness used with the highest frequency. Therefore, if printing using a special paper with a greater thickness than normal, it is not possible to receive and bundle that type of paper up to the upper limit of the number of sheets in the stacker. It is also considered meaningless to bundle at the stacker media that is not compatible with the stapling (such as OHP film and the like). For that reason, if printing to paper that is thicker than usual, that paper is discharged to a different location without being bundled, and only paper of the normal thickness is selected to be stacked in the stacker.

In this kind of circumstance, the suitability of sheets is uniformly determined according to the type of paper; paper that is determined to be unsuitable is discharged without being placed in a bundle. On the other hand, print-job demands in recent years have become broadly diversified. For example, there has been an increase in demand to use special paper types in several pages of the sheet bundle, and to print a large majority using normal paper, and then to bind these together to form a booklet.

Conventionally, however, including the related art, it has been decided to handle paper types uniformly, so even with a demand to include thick sheets in a sheet bundle of paper after printing for binding, there are no tools to respond to such requests.

Thus the present invention provides a technology that responds to diversifying demands for processing conducted after printing using a plurality of types of paper.

The present invention is an image-forming system equipped with an image-forming apparatus that transfers images formed based on image data onto paper and discharges the paper, performs a finishing process on paper discharged from the image-forming apparatus and stacked at a predetermined position; and a finisher that discharges the finished paper.

The image-forming system processes image data in job units including a plurality of pages when forming images using the image-forming apparatus. Also, it is specified in each job whether the finisher is the discharge destination of the paper transferred with images by the image-forming apparatus. For that reason, as a rule, the finisher is the discharge destination for all pages belonging to a job in which the finisher is designated to be the discharge destination.

Also, for jobs where the finisher has been designated to be the discharge destination, paper types to be transferred with images by the image-forming apparatus are specified by the system for at least each single page in that job. The system is prepared in advance with a plurality of paper types for the transfer of images by the image-forming apparatus. It supplies the specified paper type for each single page in the job. For that reason, even in jobs where the finisher is specified as the discharge destination, different types of paper can be used for each page.

Moreover, the system of the present invention determines whether the finisher is appropriate as the discharge destination of paper after the transfer of images for each single page in the job, based on the type of paper. If the system determines that the finisher is inappropriate, it immediately changes the discharge destination for only that sheet. Instead, the system tallies in the job the number of sheets determined to be inappropriate and determines whether that value is below a limited number of sheets. The result is that if that value is below the limited number of sheets, it sets the finisher to be the discharge destination of paper even if that paper is determined to be inappropriate.

In this way, even if paper types are used that are inappropriate for the finisher to be the discharge destination, the image-forming system of the present invention allows those paper types to be included in a sheet bundle, if the quantity of paper is below a fixed, limited number of sheets. Therefore, discharge to the finisher is not rejected uniformly by the type of paper; finishing can be implemented after printing with a certain degree flexibility.

Furthermore, the system changes the designated discharge destination to another position, and does not use the finisher if the number of sheets of paper of a type determined to be inappropriate exceeds the limited number of sheets. This prevents the paper from exceeding the mechanical capacity for sheet bundles in the finisher, and prevents mechanical trouble, such as paper jams.

The usefulness of the present invention is demonstrated not only when the finisher is designated as the discharge destination after printing, but also when a finishing process using the finisher is actually set.

In other words, the image-forming system specifies in each job whether to perform a finishing process using the finisher on the paper transferred with images by the image-forming apparatus. For that reason, as a rule, the finisher is the discharge destination for all pages belonging to a job in which a setting was made to perform the finishing process.

Also, for jobs to execute finishing, paper types to be transferred with images by the image-forming apparatus are specified for at least each single page in that job by the system. The system is prepared in advance with a plurality of paper types for the transfer of images by the image-forming apparatus, and supplies the specified paper type for each single page in the job. For that reason, even in jobs set to execute finishing, different types of paper can be used for each page.

Moreover, the system of the present invention determines paper after the transfer of images for each single page in the job is appropriate for finishing, based on the type of paper. If the system determines that the paper is inappropriate, it immediately stops the finishing process for only that sheet. Instead, the system tallies in the job the number of sheets determined to be inappropriate and determines whether that value is below a limited number of sheets. The result is that if that value is below the limited number of sheets, it sets to perform the finishing process for that paper even if that paper is determined to be inappropriate.

In this way, even if paper types that are inappropriate for the finishing process are used, the image-forming system of the present invention allows those paper types to be included in a sheet bundle, if the quantity of paper is below a fixed, limited number of sheets. Therefore, paper is not rejected from targeting in the finishing process uniformly by the type of paper; finishing can be implemented after printing with a certain degree flexibility.

Furthermore, the system cancels the set finishing process, if the number of sheets of paper of a type determined to be inappropriate exceeds the limited number of sheets. This prevents the paper from exceeding the mechanical capacity for sheet bundles in the finisher, and prevents mechanical trouble, such as paper jams.

Thus, the image-forming system of the present invention not only determines uniform support by determination of only the paper type used, but has a determination standard for whether prohibited paper included in a discharged unit (job unit) such as a sheet bundle is within an allowable range. With regard to the output within the limited number of sheets, this makes it possible to output to a discharge destination that was conventionally prohibited.

Also, for the resulting product obtained from the image-forming system, this makes it possible to adequately satisfy the diversifying demands of users to use thick sheets only for the front and back covers of a booklet, for example, if the mechanical specifications allow for this.

Also, with regard to print output where only interleaving paper (slip sheets) is a special paper type in one sheet bundle, but normal paper composes a majority of the pages in print output to the finisher, this prevents a limitation in the operation where only the pages of the interleaving paper are output to a tray in the image-forming apparatus. Therefore, the system does not cause trouble for the user for the print output material. (Such as the problem of having to collect output materials from two separate discharged locations.)

BEST MODE FOR CARRYING OUT THE INVENTION

An embodiment of a system combining a multi-function peripheral (hereinafter referred to simply as MFP) and finisher will now be explained as an example of an image-forming systems according to the present invention.

Figure 1:
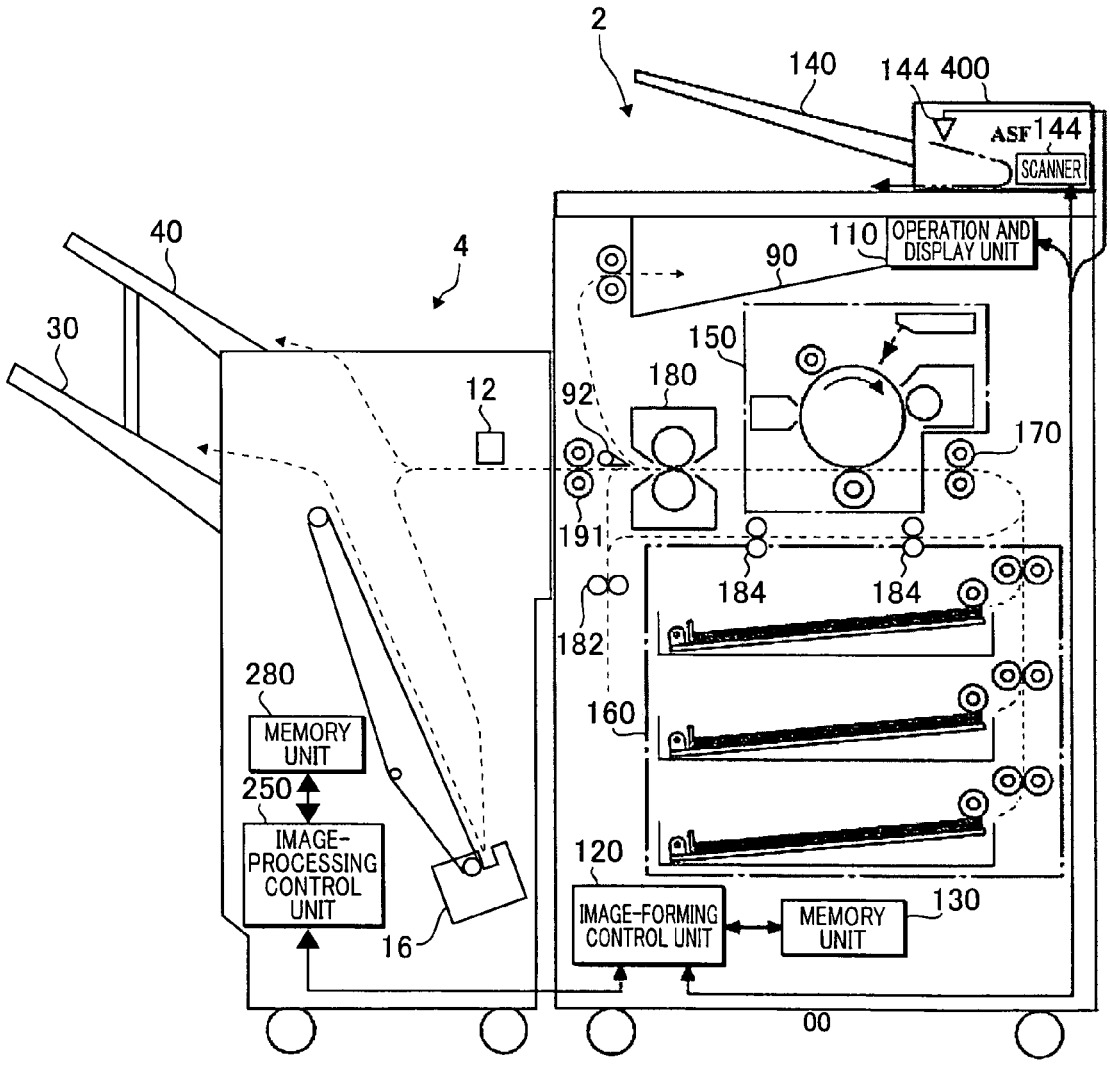
FIG. 1 is a composition drawing schematically showing image-forming systems of one embodiment.

FIG. 1 is a composition drawing schematically showing an image-forming system of one embodiment. The image-forming system is composed by combining the MFP 2 and finisher 4. The MFP 2 functions as a network printer, network scanner and Internet facsimile sending and receiving machine, in a network environment of a local area network (or so-called LAN) or the like. The MFP 2 can be used stand-alone as a copier or facsimile sending and receiving machine. Because the image-forming system operates over a network, the MFP 2 is connected to a network, not shown. It is possible to implement any known network infrastructure or an interface for connection to that. Note that a plurality of computers (user PCs), not shown, and servers and the like are connected to the network. First, the basic configuration and functions of the MPF 2 and finisher 4 will be explained.

As shown in FIG. 1, an image-forming control unit 120 is provided on the MFP 2, and the finisher control unit 250 is provided on the finisher 4. These control units 120 and 250 are composed of electronic circuits equipped with a central processing unit (CPU) for example. These electronic circuits are formed on circuit boards which are installed in the MFP 2 and finisher 4. Memories 130 and 280 are connected to each of these control units 120 and 250. These memories 130 and 280 have memory devices (ROM, RAM) and large capacity storage (hard disks).

With the MFP 2, data set by operating the operation and display unit 110 is stored in the memory 130 via the image-forming control unit 120. This setting includes paper size, type and feed direction, original density, removal of frames, binding and 4-in-1 concentrated processing. Image processing is performed according to these settings. The time for the MFP 2 to process the images depends on the content of these settings. Application programs for the MFP to perform multi-thread processes are stored in the memory 130 joined to the image-forming control unit 120.

For example, with image processing accompanying duplication of an original, an original is placed on a tray 140 of an auto-sheet feeder 400. When the user presses a start button (not shown) on the operation and display unit 110, the following processes are performed according to that operation. Initially, a paper sensor 143 installed in the auto-sheet feeder 400 detects an original; the auto-sheet feeder 400 feeds one original at a time, and the original is discharged. In the process to be discharged, a scanner 144 scans the images on the original. Read image data is stored in one job unit in the memory 130 via the image-forming control unit 120.

The image-forming control unit 120 performs preprocesses on the image data, such as eliminating image noise, then performs image processing according to the various settings and supplies that data to a print engine 150 in page units. Thus, a static-electric latent image is formed on a surface of a photosensitive drum of the print engine 150.

On the other hand, inside the MFP 2, paper taken from a sheet feeder unit 160 is fed to registration rollers 170 and is temporarily stopped there. When the photosensitive drum of the print engine 150 has reached a predetermined angle of rotation, the paper is conveyed again by the registration rollers 170 at that time thereby transferring the toner image to the paper. The paper passed a fuser unit 180 and is applied with heat and pressure there. This fuses the toner image to the paper. The paper transferred with the toner image becomes a transferred sheet. The transferred sheet is discharged by passing between a pair of upper and lower discharge rollers 191, and is subsequently handed over to the finisher 4.

With this embodiment, a sheet feeder section (paper feeder tray) is composed of three trays, for example, in the sheet feeder unit 160. Settings are made in the sheet feeder unit 160 for the paper sizes and type in each tray and the paper orientation. This information is stored in the memory 130. Paper-out sensors (not shown) that detect the presence of paper in each sheet feeder tray are provided. These paper-out sensors detect the presence of paper. Detection signals from the paper-out sensors are input to the image-forming control unit 120.

It is possible to detect paper sizes by a size detection sensor (not shown) disposed in each sheet feeder tray of the sheet feeder unit 160. Detection signals from the size detection sensors are input to the image-forming control unit 120. The image-forming control unit 120 grasps information relating to the presence of paper stored in each sheet feeder tray and the paper sizes in each tray based on the paper-out sensor and the size detection sensor signals.

The image-forming control unit 120 is able to grasp information relating to the paper type (media type) by the user inputting that information for each sheet feeder tray via the operation and display panel 110. Note that the information grasped by the image-forming control unit 120 is stored in the memory 130.

It is possible, for example, to specify for each page in a job being executed, which paper type should be supplied from the sheet feeder unit 160. For example, it is possible for a user to send a print request (job) from a computer via the network, to include information relating to the paper type for each page in the print request. Or, the user can operate the operation and display unit 110 to specify the paper type (sheet feeder tray) for all pages included in that job.

In either case, information relating to the paper type specified with the job is stored in the memory 130. The image-forming control unit 120 determines the type of paper for each single page when forming images using the print engine 150 and supplies the specified type of paper from the sheet feeder unit 160 (from the sheet feeder tray that corresponds to that paper type).

The MFP 2 has a function for printing to both sides of paper (duplex printing). A pair of paper turn-over rollers 182 are disposed further downstream than the fuser unit 180 looking from the direction of paper conveyance, and in a position therebelow. A pair of duplex printing rollers 184 is arranged above the sheet feeder unit 160, and at a position below the print engine 150. A duplex printing paper conveyance path is formed along the arrangement of these pairs of paper turn-over rollers 182 and duplex printing rollers 184.

When performing duplex printing on paper in the MFP 2, the paper conveyance path switches downward in front of the pair of discharge rollers 191 after the sheet has passed the fuser unit 180 allowing the paper transferred on one side with an image to be conveyed further downward. The pair of paper turn-over rollers 182 initially further conveys the sheet downward, then when the upstream edge side of the sheet reaches the pair of paper turn-over rollers 182, the rollers rotate in the reverse conveyance direction. The direction of conveyance switches for the sheet conveyed upward by this reverse rotation to bend under the fuser unit 180 to the right side of FIG. 1 and the leading edge of the sheet is conveyed by the pair of duplex printing rollers 184. Then, the paper is fed again to the registration rollers 170, and fed to the print engine 150 synchronized to the print timing to the other side.

The MFP 2 is provided with a discharge tray 90 above the unit. The discharge tray 90 is a so-called in-body type tray. Here, sheets are discharged with the printed surfaces (the front surfaces) facing downward. The discharge tray 90 of the main unit is used for jobs in which the user has not specified any particular finishing process such as stapling or the punching of holes.

Note that the selection of whether to discharge a sheet after images have been fixed thereupon at the fuser unit 180 to the discharge tray 90 or to the finisher 4 is done by changing the position of a switcher 92. When performing duplex printing, the switcher 92 also operates to guide a sheet fixed with an image on one side downward.

Figure 2:
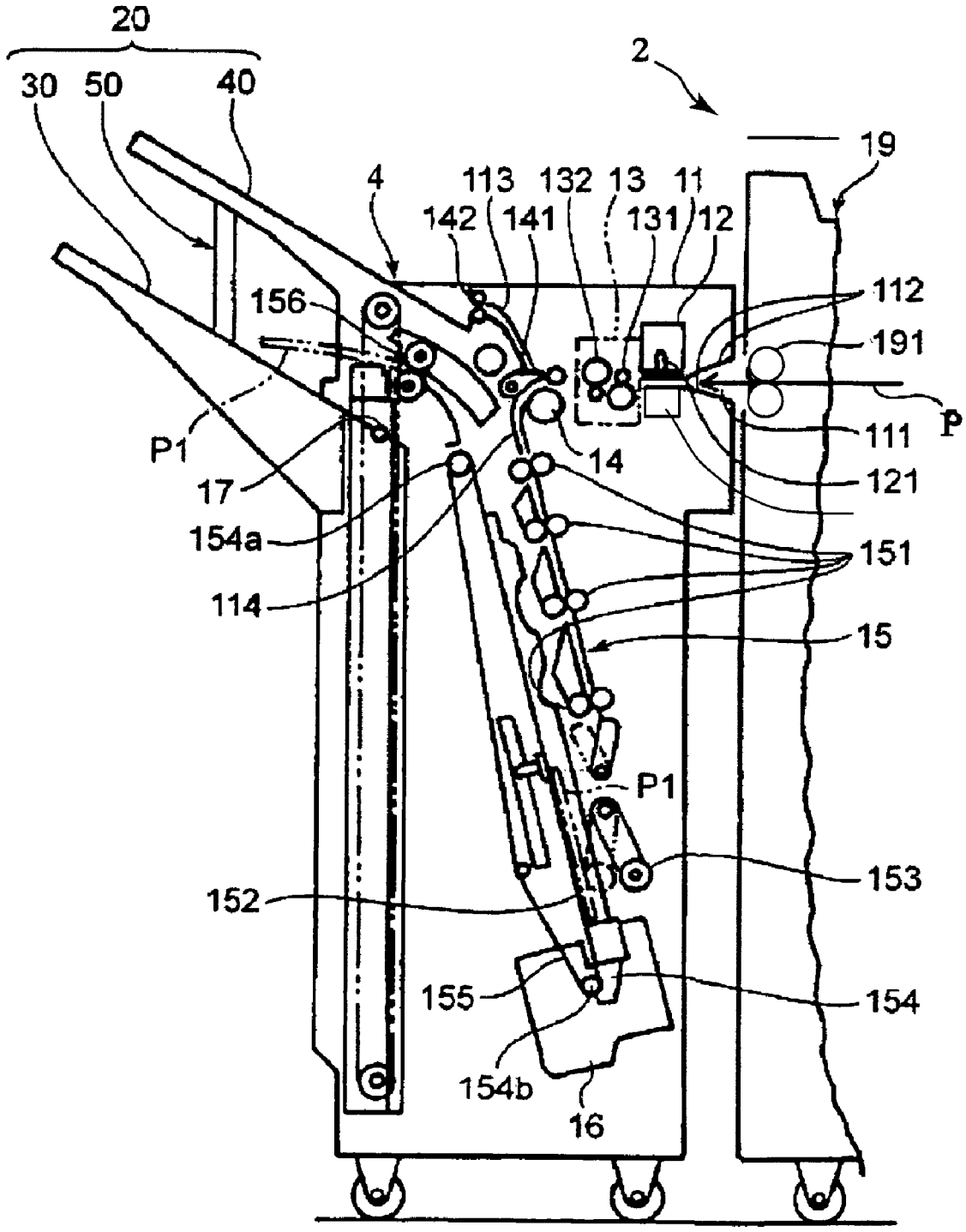
FIG. 2 is a front cut-away view to explain an internal structure of a finisher.

FIG. 2 is a front cut-away view to explain an internal structure of the finisher 4. As shown in FIG. 2, the finisher 4 punches holes in the transferred sheet P (the punching process) or binds with staples (the stapling process) a sheet bundle P1 temporarily stocked. Punched with holes or stapled, the transferred sheet P is discharged from the finisher 4 as a finished sheet.

The finisher 4 is provided with a housing (the apparatus unit) 11 that has a substantially rectangular shape. A paper conveyance inlet 111 is formed in this housing 11 at a position opposing a pair of discharge rollers 191 of the MFP 2. Also, a discharge apparatus 20 that receives discharged transferred sheets P from the finisher 4 is disposed on a side surface on the opposite side of the paper conveyance inlet 111 in the housing 11.

The discharge apparatus 20 has two trays arranged vertically at two levels. In this embodiment, the tray positioned on the bottom side is the main tray 30, and the tray positioned on the top side is the sub tray 40. The sheet bundle P1 having been stapled is discharged to the main tray 30. The stapling process is performed with the discharge mode of the finisher 4 set to a stapling mode. When this stapling mode is set, the finisher 4 temporarily accumulates the sheet bundle P1 in the center portion inside the housing 11, then operates to discharge the stapled sheet bundle P1 to the main tray 30 after the stapling process. Transferred sheets P discharged one at a time are discharged to the other sub tray 40 without undergoing the stapling process. An aligning member 50 that aligns the sheet bundle P1 on the main tray 30 is disposed between the main tray 30 and the sub tray 40. Each of the trays 30 and 40 are inclined so that the downstream side in the direction of sheet discharge is rising. Note that the discharge modes set for the finisher 4 can be the staple mode, a non-staple mode or sorting mode where stapling is not performed, or a non-sorting mode.

In either mode, the transferred sheet P discharged from the pair of discharge rollers 191 of the MFP 2 is guided to the inside of the finisher 4, then after the hole punching or stapling process is performed, the sheet P is discharged to the targeted main tray 30 or the sub tray 40. In addition to normal paper, recording media such as tracing paper, OHP sheets and other types of sheets are included in transferred sheets P.

A pair (top and bottom) of guide plates 112 are provided in the sheet conveyance inlet 111. These guide plates 112 are arranged in a tapering shape (narrowing ends) from an upstream side toward a downstream side looking from the discharge direction of the transferred sheet P. To perform the punching process, a punching machine 12 is disposed in a position adjacent to the sheet conveyance inlet 111. The transferred sheet P discharged from the pair of discharge rollers 191 is conveyed to the punching machine 12 by being guided by these guide plates 112.

The punching machine 12 is equipped with punching rods 121 for punching two holes, for example. These punching rods 121 are arranged with a fixed distance (for example a distance standardized for a two-hole binder) in a direction perpendicular to the discharge direction of the transferred sheet P. When the transferred sheet P is conveyed, the punching machine temporarily stops the leading edge position of the transferred sheet P using a stopper, not shown. The punching rods 121 are lowered with the sheet positioned thereby punching holes at predetermined positions in the transferred sheet P. The punch rods 121 penetrate the transferred sheet P in the downward movement and are inserted into a predetermined punch bearing hole disposed in a base further below. A punch scrap receptacle 122 is arranged below the punching machine. The punch scraps (the portion punched from the paper) generated in the punching process are stored in the punch scrap receptacle 122. In this way, the hole punching process is executed on the transferred sheet P. After the stopper of the punching machine 12 is retracted, drive of the pair of discharge rollers 191 feeds the transferred sheet P to the curl remover apparatus 13.

At the curl remover apparatus 13, the curl (bending of the sheet) in the transferred sheet P generated by the heat of the MFP 2 in the fusion process is removed. The curl remover apparatus 13 is equipped with two sets of pairs of curl removing rollers 131 and 132. These two sets of pairs of curl remover rollers 131 and 132 return the transferred sheet P to a flat state by correcting with curls of mutually opposite directions. The directions of curls differ according to the status of the formed images on the transferred sheet P (whether images were transferred to a single side or both sides of the transferred sheet P), but if the MFP 2 has a duplex printing mechanism, it is particularly effective to correct to both directions.

A pair of a large and a small conveyance rollers 14 are disposed in a downstream position of the curl remover apparatus 13, looking in the direction of paper conveyance, in the housing 11. Also, a first paper conveyance path 113 that extends obliquely upward toward the sub tray 40, and reverse to that a second paper conveyance path 114 that extends obliquely downward are formed downstream of the pair of conveyance rollers 14. The first paper conveyance path 113 and second paper conveyance path 114 branch upward and downward at a position of the pair of conveyance rollers 14. A branching claw 141 is disposed in the branching point of these; a destination of the conveyance of the transferred sheet P is switched to the first or the second paper conveyance paths 113 and 114 by this branching claw 141. Namely, when the branching claw 141 closes the second paper conveyance path 114, it opens the first paper conveyance path 113 for passage of the transferred sheet P. In this state, the transferred sheet P fed from the pair of conveyance rollers 14 is guided by the branching claw 141 and the first paper conveyance path 113 is conveyed up to the nipping position of the pair of discharge rollers 142 for the sub tray, and is discharged to the sub tray 40 by the drive of the pair of discharge rollers 142 for the sub tray. On the other hand, when the branching claw 141 closes the first paper conveyance path 113, the second paper conveyance path 114 is open for passage by the transferred sheet P. The transferred sheet P fed from the pair of conveyance rollers 14 is guided by the branching claw 141 and the second paper conveyance path 114 and conveyed into the intermediate tray 15.

There are four paper conveyances in mechanism 151 disposed sequentially in series in the second paper conveyance path 114. These paper conveyances in mechanisms 151 guide the transferred sheet P to a paper stacker 152 of the intermediate tray 15 by a different path depending on the size. The paper stacker 152 is set to a capacity to hold a plurality of transferred sheet P (for example, approximately 20 sheets with normal paper). The transferred sheet P fed to the paper stacker 152 is fed further downward by a pressing roller 153, and is stopped when positioned at a stopper member 154. Next, the transferred sheet P conveyed via the second paper conveyance path 114 is positioned by the stopper member 154 to overlap its transferred surface (when simplex printing is applied) on the backside of the former transferred sheet P. In this way, when the sheet bundle P1 is formed by aligning a plurality of the transferred sheet P on the paper stacker 152, the stapling process is performed on the sheet bundle P1 by the stapler 16.

A drive pulley 154*a* is provided near a top end of the second paper conveyance path 114, in other words at an uppermost position of the paper stacker 152. On the other hand, a follower pulley 154*b* is provided near a bottom end of the second paper conveyance path 114, in other words at an bottommost position of the paper stacker 152. An endless belt 155 is trained between these pulleys 154*a* and 154*b*; the stopper member 154 is fastened to this endless belt 155. Therefore, when the drive pulley 154*a* is rotated after the stapling process is applied to the sheet bundle P1, the sheet bundle P1 supported by the stopper member 154 is lifted upward and conveyed to the nipping position of a pair of discharge rollers 156 for the main tray. Also, the sheet bundle P1 is conveyed to the main tray 30 by the drive of the pair of discharge rollers 156 for the main tray.

The main tray 30 is configured to move in up and down directions along a side surface of the finisher 4. The upper surface position of the main tray 30 is detected by a sensor 17 in the finisher 4; the upper surface position of the main tray 30 is controlled to constantly be at an optimum height position to stack the sheet bundle P1. This makes it possible to discharge a new sheet bundle P1 without interfering with a sheet bundle P1 stacked already stacked on the main tray 30, even if a large volume of transferred sheets P are discharged to the main tray 30.

An aligning member is disposed between the main tray 30 and sub tray 40 to align the leading edge of the sheet bundle P1 discharged to the main tray 30. The sheet bundles P1 sequentially discharged from the paper stacker 152 by the drive of the endless belt 155 to the main tray 30 via the pair of discharge rollers 156 for the main tray are aligned by the action of the aligning member 50. This eliminates the problem of mis-alignment of a plurality of stacked sheet bundles P1.

Finishing functions to punch holes or staple the transferred sheet P after image transfer are provided in the finisher 4, described below. With the image-forming system, the user can set whether to punch holes or staple the sheets in the finisher 4 for each single job for example by operating the operation and display unit 110 of the MFP 2, or specifying when sending the print request via the network.

Specifically, if the user requests the punching of holes for filing the transferred sheet P in a job to be executed, the user can perform the predetermined operations (such as pressing buttons or operating a touch panel or the like) via the operation and display unit 110 to make settings to execute the hole punching process at the finisher 4. The user can also specify the hole punching process when sending the print request from a computer.

Additionally, if the user requests stapling for the transferred sheet P in a job to be executed, the user can perform the predetermined operations (such as pressing buttons or operating a touch panel or the like) via the operation and display unit 110 to make settings to execute the stapling process at the finisher 4. The user can also specify the stapling process when sending the print request from a computer. Still further, the user can also set to execute both the hole-punching and stapling processes in a job to be executed.

Additionally, separate to the hole-punching and stapling finishing processes, if duplex printing is being performed on the sheets, the user can perform the predetermined operations (such as pressing buttons or operating a touch panel or the like) via the operation and display unit 110 to make settings to execute duplex printing for the job. The user can also specify to perform duplex printing when sending the print request from a computer.

The contents (setting values) of the settings made by the user for each job are received by the image-forming control unit 120 of the MFP 2 and temporarily saved in the memory 130. The image-forming control unit 120 controls the drive mechanisms of the print engine 150, the pair of discharge rollers 191, the paper turn-over rollers 182, the pair of duplex printing rollers 184, and the switcher 92 and the like based on the settings of each job, and sends operating instructions to the finisher control unit 250. This operation instruction signal includes information such as paper size, paper type, number of sheets to print and printing format (simplex or duplex) for each job, and includes instructions relating to the hole-punching or stapling processes. The finisher control unit 250 controls the operations of the punching machine 12 and stapler 16 according to the received instruction signals, and controls the operations of the branching claw 141, paper conveyance in mechanisms 151 and drive pulley 154*a*, and the upward and downward movement of the main tray 30. The result is that for each job, the user performs operations to set the finishing contents individually, and the finisher 4 performs the necessary operations of each according to the settings.

These are the basic configuration and functions of the MPF 2 and finisher 4. Additionally, with this embodiment, the image-forming control unit 120 of the MFP 2 executes a discharge destination search process as a program, and the result is that the image-forming system implements the following operations. Note that with the explanation below, paper transferred with an image is not called a transferred sheet. It is simply referred to as paper. Also, the word paper is not limited to paper material. The concept is broader and includes other materials including resin and the like.

Figure 3:
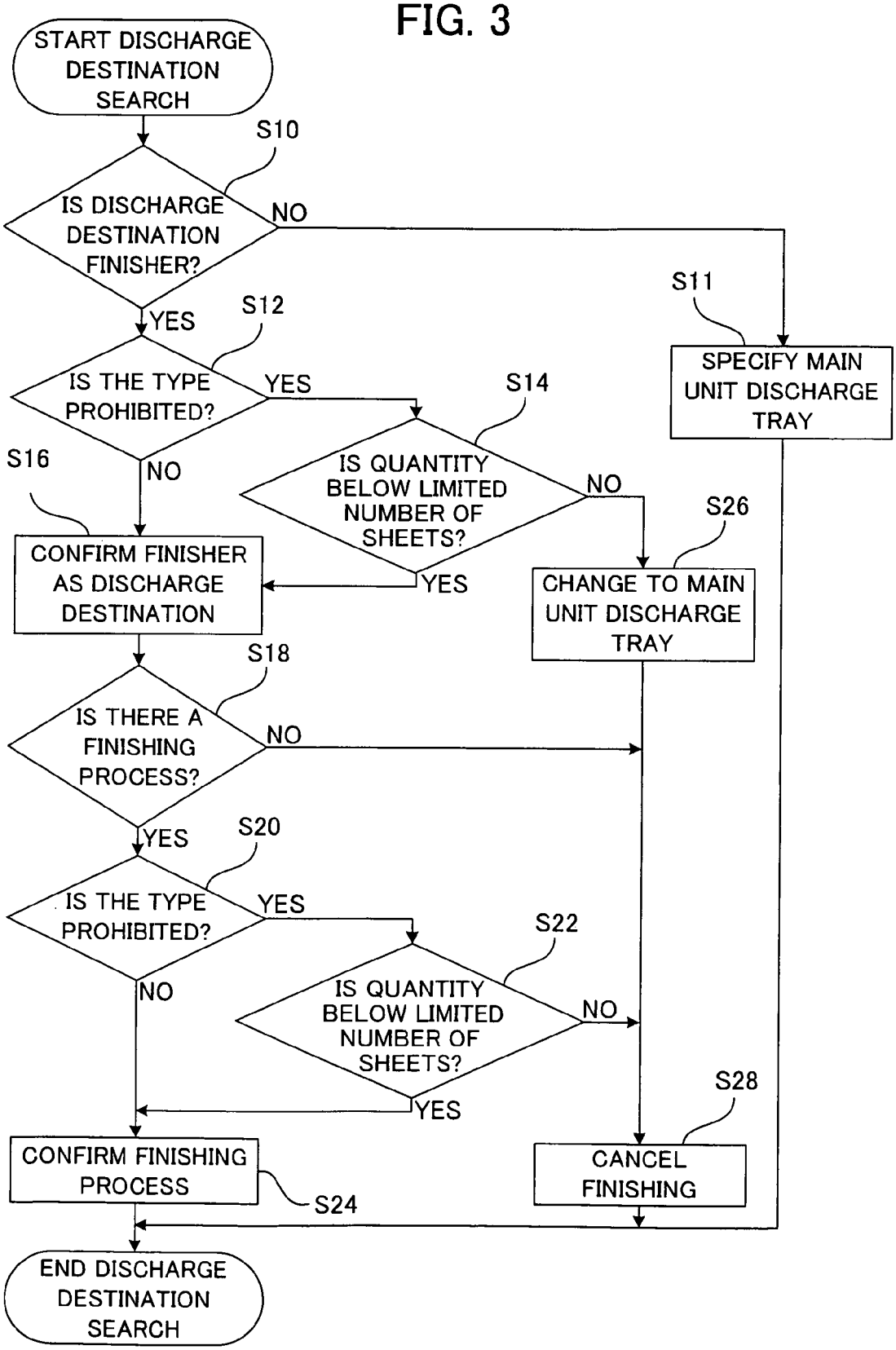
FIG. 3 is a flowchart showing procedures of a discharge destination search process.

FIG. 3 is a flowchart showing procedures of a discharge destination search process executed by the image-forming control unit 120. This discharge destination search process is executed for each single sheet fused with an image. For example, if one user job includes a total of 50 sheets of printed images, the image-forming control unit 120 executes the processes shown in FIG. 3 for each single sheet of the total of 50 sheets to determine whether the discharge destination should be the finisher 4 or the discharge tray 90 of the main unit. The following will now explain the processes according to the procedures of the flowchart.

Step S10: The image-forming control unit 120 determines whether the discharge destination of the paper after printing for the job being executed is the finisher 4. This determination is performed based on whether the finisher 4 has been specified as the discharge destination for the job currently being executed, for example. For example, if a print request was sent from a computer (a user PC) on the network to the MFP 2, and information is included in that print request that indicates the discharge destination is the finisher 4, the image-forming control unit 120 can determine that the discharge destination is the finisher 4. (Yes)

Step S11: Particularly, if the finisher 4 is not specified as the discharge destination in the job being executed, (Step S10=No), the image-forming control unit 120 selects the discharge tray 90 of the main unit as the discharge destination and ends this search process. Note that if the discharge destination is set to the discharge tray 90 of the main unit as the initial setting (default setting) of the MFP 2, step S11 can be omitted.

Step S12: The image-forming control unit 120 determines whether the paper type (the target for printing) for which the discharge destination is being searched is prohibited to be discharged to the finisher 4. The types of paper handled by the image-forming system vary, even if they are the same A4 size. For example, there are normal sheets and thick sheets that have a greater thickness than normal sheets. In the same way, types can vary between paper materials and resin materials such as OHP film (included in a broader sensor of paper).

Normally, paper is discharged to the finisher 4, and if the stapling process is applied the paper discharged from the MFP 2 must be stacked in order and bundled at the intermediate tray 15. At that time, for mechanical reasons, an upper limit (for example, approximately 50 sheets) is set for the number of sheets that can reasonably be stacked using a normal sheet type as a standard. Stacking to the intermediate tray 15 is performed assuming that printing to all 50 sheets is on normal paper as a rule.

For that reason, in the printing this time, if a type of paper other than normal sheets is being used, that paper is not appropriate to be stacked in the intermediate tray 15. That paper type is prohibited as a paper type to use the finisher 4 as the discharge destination. Therefore, if the type of paper being used this time is other than normal paper, the image-forming control unit 120 determines that the paper is prohibited for discharge to the finisher 4. (Yes) Note that this is essentially a determination. In this embodiment, even if paper that is prohibited is included in the current job, that paper can be allowed if the number of sheets is within a range of a fixed, limited number of sheets. The following controls are performed in the end to set the finisher 4 as the discharge destination for all sheets of the current job.

Step S14: The image-forming control unit 120 counts the number of printed sheets that are prohibited up to within a range of the currently executing job and determines whether that value is less than the limited number of sheets. The upper limit number of sheets (Amax) is set to 50 sheets, for example, based on when all bundled and printed sheets are a normal type, but this limited number Plim is set to a much lower value than that (for example approximately 2 to 5 sheets). This is based on a practical consideration (or empirical rules) that although a bundle of thick sheets cannot be stacked in the intermediate tray 15 if all 50 sheets are printed on thick sheet types, it is possible to stack on the intermediate tray 15 48 sheets of 50 if they are normal sheets, and approximately 2 thick sheets.

Step S16: Therefore, the image-forming control unit 120 sets the discharge destination this time for the finisher 4 if the total number of sheets that correspond to the prohibited type in this job is less than the limited number Plim (Step S14=Yes).

Step S18: Next, the image-forming control unit 120 determines whether finishing has been specified for the job currently being executed. This determination is performed based on whether stapling, for example, has been specified for the job currently being executed. In the same way, if a print request was sent from a computer (a user PC) on the network to the MFP 2, and if information is included in that print request that indicates stapling, the image-forming control unit 120 can determine that finishing has been specified. Therefore, if stapling has been specified (Yes) for the current job, the image-forming control unit 120 proceeds to step S20.

Step S20: Next, the image-forming control unit 120 determines whether the type of paper corresponds to that prohibited for finishing. The standard of this determination is basically the same as step S12. The result is that if the paper this time is not normal, but thick sheets, the image-forming control unit 120 determines that it corresponds to a paper type that is prohibited from finishing. (Yes)

Step S22: The image-forming control unit 120 counts the number of printed sheets that are prohibited up to within a range of the currently executing job and determines whether that value is less than the limited number of sheets. The limited number of sheets Plim is the same as that at step S14. This is based on a practical consideration that although a bundle of thick sheets cannot be stacked in the intermediate tray 15 if all 50 sheets are printed on thick sheet types, it is possible to stack 48 sheets of the 50 if they are normal sheets, and approximately 2 thick sheets. The stapling process can then be applied without problems.

Step S24: The image-forming control unit 120 sets the finishing process to be executed (in this case, a stapling process) for the paper printed this time, if the total number of sheets that correspond to the prohibited type for finishing in this job is less than the limited number Plim (Step S24=Yes).

This ends a series of the image-forming control unit 120 discharge destination search process. The result is that that paper is actually discharged to the finisher 4, and stacked in the intermediate tray 15.

Then, if the type of paper used in the next print in the same job is normal paper, it is not a prohibited type at either steps S12 or S20 (No). For that reason, if normal paper is used consecutively up to the $48^{th}$ page, for example, the discharge destination is determined to be the finisher 4 at step S16 during that time, and it is determined to execute the finishing process at step S24.

Then, if the type of paper used in printing the last sheet in the same job is a thick sheet, the image-forming control unit 120 performs the following processes.

In other words, although it is determined at step S12 that the paper is prohibited, if the total number of sheets up to that point is within the range of the limited number of sheets Plim (for example, a total of two sheets), it is determined that that is under the limited number of sheets Plim at step S14, and the discharge destination is determined to be the finisher 4 at step S16.

In the same way, although it is determined at step S20 that the paper is prohibited, if the total number of sheets up to that point is within the range of the limited number of sheets Plim (for example, a total of two sheets), it is determined that that is under the limited number of sheets Plim at step S22, and finishing is determined at step S24.

The result is that if 48 sheets of paper used in printing in one job are the normal type of sheets, and only 2 are the thick type of sheets, the bundle targeted for printing formed for this job is finally discharged to the main tray 30 after being stapled at the finisher 4.

Figure 4A:
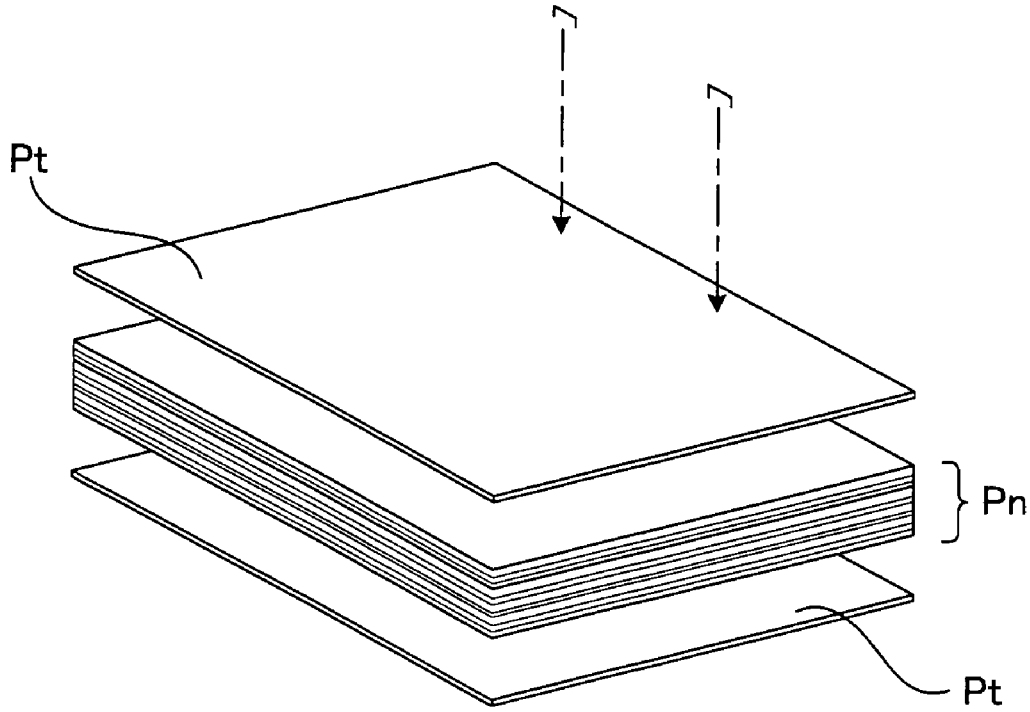
FIGS. 4A and 4B are perspective views of an example bundle targeted for printing formed along with an execution of the discharge destination search process.
Figure 4B:
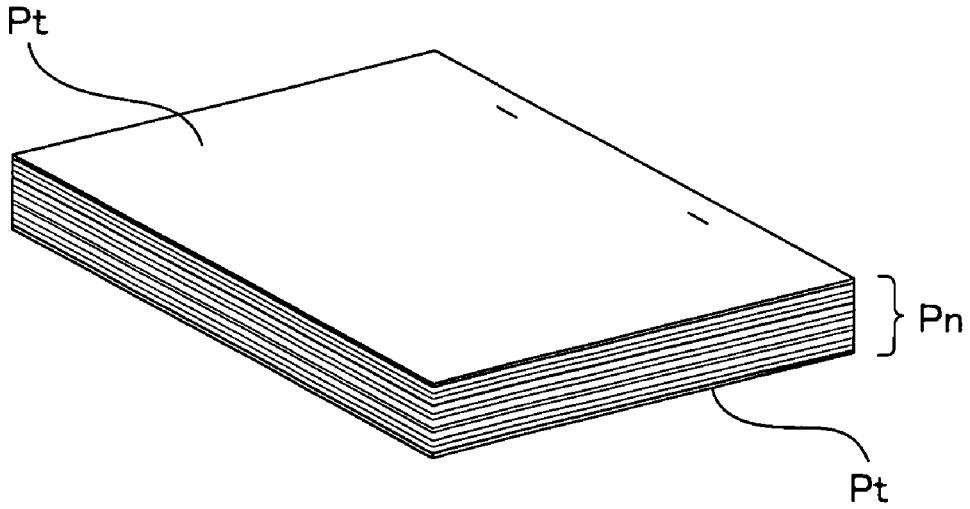

FIG. 4 is a perspective view of a preferred example of a bundle targeted for printing formed along with an execution of the discharge destination search process.

(A) in FIG. 4 is an exploded view. It shows a sheet bundle of 50 sheets of printed material obtained in one job, and only two thick sheets Pt (back and front covers) printed; 48 pages of the leaves of the sheet bundle are sandwiched therebetween. All 48 sheets are normal paper Pn.

(B) in FIG. 4 shows the sheet bundle finally discharged to the main tray 30 of the finisher 4 and stapled in two places on the edges, for an example. The front and back covers are thick paper Pt that finish the booklet.

Note that this is only an example. The thick sheets Pt can be positioned anywhere within the bundle. The users can specify the arrangements of the thick sheets Pt in any position (which number of sheet in the bundle) in the job to be executed.

The limited number of sheets Plim of the thick sheets Pt can be determined based on mechanical specifications and structure of the finisher 4 that is actually operating; that value does not have any particular limitation.

The explanation above provided an example where the discharge destination search process is executed within a range where the finishing process such as stapling or the like can be realistic allowed, even if normal sheets and thick sheets are being used in the job. If this tolerance range is exceeded, and thick sheets or the like are used, the following processes are performed for that job.

In other words, if the image-forming control unit 120 determines at step S14 that the number of sheets being used in printing in this job exceeds the limited number of sheets Plim (No), it proceeds to steps S26 and S28.

Step S26: The image-forming control unit 120 changes the discharge destination to the discharge tray 90 of the main unit. This causes the finisher 4 to be canceled as the discharge destination specified with this job.

Step S28: The image-forming control unit 120 cancels the specification of the finishing process. This causes the specification to be canceled even if the stapling process was specified for this job.

The result is that if the thick paper other than the normal paper used in printing exceeds limited number of sheets Plim in one job, the discharge destination for that portion is changed to the discharge tray 90 of the main unit to enable preventing thick sheets that exceed the mechanical tolerance limit of the intermediate tray 15 from being stacked.

Note that if the number of sheets of the bundle to be printed with one job executed by the user is set for the limited number of sheets, the limited number of sheets will not be exceeded at step S14, and the discharge destination will constantly be set to the finisher 4. For that reason, although the total printing speed will decrease, jobs within the limited number of sheets will be repeated resulting in it being possible to discharge sheets that exceed the limited number of sheets from the finisher 4. In that case, it is not necessary to collect the printed materials from the discharge tray 90 of the main unit and the finisher 4, making it very convenient for the user.

The present invention is not restricted to the embodiment described above. It is possible to implement various modifications thereto. The flowchart shown in FIG. 3 is only an example of a preferred embodiment. It is acceptable to change the contents of procedures, or the order of arrangements as is proper. For example, at step S26 in FIG. 3, the discharge destination is changed to the discharge tray 90 of the main unit, but it is also acceptable to change the discharge destination to the sub tray 40 of the finisher 4. In such cases, the discharged paper is discharged without being stacked in the intermediate tray 15, so a paper jam does not occur in the intermediate tray 15.

Thick paper was provided as an example of prohibited material with this embodiment, but it is also possible to target OHP film, or thin paper such as tracing paper, or letter paper.

Furthermore, the MFP 2 was provided as an example in this embodiment, but the image-forming system can be equipped with printing and finishing functions. The various members and drive components included in the image-forming apparatus such as the MFP 2 or the finisher are examples of preferences, but it is possible to implement these with a variety of modifications.

What is claimed is:

1. An image-forming system, comprising:

an image-forming apparatus that transfers to paper an image formed based on image data and discharges the paper;

a finisher that performs a finishing process on the paper discharged from the image-forming apparatus and stacked at a predetermined position;

image-processing means that processes the image data in job units including a plurality of pages when forming images using the image-forming apparatus;

discharge destination search means that specifies in each lob whether the finisher is the discharge destination of the paper with the images transferred by the image-forming apparatus;

type specifying means that specifies a type of paper to be transferred with the images by the image-forming apparatus for at least each single page in a job, for jobs where the finisher has been designated as the discharge destination by the discharge destination search means;

feeding means that is prepared in advance with a plurality of types of paper to be transferred with the images by the image-forming apparatus and supplies a sheet of paper of a type that corresponds to each single page of the lob, based on a specification provided by the type specification means;

first type prohibition determining means that determines based on the paper type whether the finisher is appropriate as the discharge destination for the sheet of paper after the transfer of the images by the image-forming apparatus for each single page in the job;

first limited number of sheets determining means that counts a total number of pages determined as inappropriate by the first type prohibition determining means and determines whether the total number of pages is below a predetermined limited number of sheets of paper;

discharge destination setting means that sets the finisher as the discharge destination of the sheet of paper when the first limited number of sheets determining means determines that the total number of pages is below the predetermined limited number of sheets of paper, even if the first type prohibition determining means determines the finisher as an inappropriate discharge destination; and discharge destination changing means that changes the discharge destination specified by the discharge destination specification means not to the finisher but to another destination when the first limited number of sheets determining means determines that the total number of pages is not below the predetermined limited number of sheets of paper.

2. The image-forming system according to claim 1, further comprising:

finisher setting means that determines whether the finisher performs the finishing process for each job unit; and second type prohibition determining means that determines based on the paper type whether the finishing process is appropriate using the finisher on the sheet of paper after the transfer of images by the image-forming apparatus for each single page in the job;

second limited number of sheets determining means that counts the total number of pages determined as inappropriate by the second type prohibition determining means and determines whether the total number of pages is below the predetermined limited number of sheets of paper; and finisher confirming means that confirms the execution of the finishing process performed by the finisher for the sheet of paper when the second limited number of sheets determining means determines that the total number of pages is below the limited number of sheets of paper, even if the second type prohibition determining means determines the finishing process inappropriate, wherein the type specifying means specifies the type of paper for the jobs for which the finisher setting means determines to perform the finishing process.

3. The image-forming system according to claim 2, further comprising:

finisher canceling means that cancels the finishing process set by the finisher setting means when the second limited number of sheets determining means determines that the total number of pages is not below the predetermined limited number of sheets of paper.

4. An image-forming system, comprising:

an image-forming apparatus that transfers to paper an image formed based on image data and discharges the paper;

a finisher that performs a finishing process on the paper discharged from the image-forming apparatus and stacked at a predetermined position;

image-processing means that processes the image data in job units including a plurality of pages when forming images using the image-forming apparatus;

discharge destination search means that specifies in each job whether the finisher is the discharge destination of the paper with images transferred by the image-forming apparatus;

finisher setting means that determines whether the finisher performs the finishing process for each job unit;

type specifying means that specifies a type of paper to be transferred with the images by the image-forming apparatus for at least each single page in a job, for jobs where the finisher has been designated as the discharge destination by the discharge destination search means, or for which the finisher setting means has determined to perform the finishing process;

feeding means that is prepared in advance with a plurality of types of paper to be transferred with the images by the image-forming apparatus and supplies a sheet of paper of a type that corresponds to each single page of the job, based on a specification provided by the type specification means;

a first type prohibition determining means that determines based on the paper type whether the finisher is appropriate as the discharge destination for the sheet of paper after the transfer of the images by the image-forming apparatus for each single page in the job;

a second type prohibition determining means that determines based on the paper type whether the finishing process is appropriate using the finisher on the sheet of paper after the transfer of the images by the image-forming apparatus for each single page in the job;

a first limited number of sheets determining means that counts a total number of pages determined as inappropriate by the first type prohibition determining means and determines whether the total number of pages is below a predetermined limited number of sheets of paper; and discharge destination setting means that sets the finisher as the discharge destination of the sheet of paper when the first limited number of sheets determining means determines that the sheet is below the predetermined limited number of sheets of paper, even if the first type prohibition determining means determines the finisher as an inappropriate discharge destination;

a second limited number of sheets determining means that counts the total number of pages determined as inappropriate by the second type prohibition determining means and determines whether the total number of pages is below the predetermined limited number of sheets of the paper; and finisher confirming means that confirms the execution of the finishing process performed by the finisher for the sheet of paper when the second limited number of sheets determining means determines that the total number of pages is below the predetermined limited number of sheets of paper, even if the second type prohibition determining means determines the finishing process as inappropriate and discharge destination changing means that changes the discharge destination specified by the discharge destination specification means not to the finisher but to another destination when the first limited number of sheets determining means determines that the total number of pages is not below the predetermined limited number of sheets of paper.

* * * * *